United States Patent [19]

Erickson

[11] 3,952,369

[45] Apr. 27, 1976

[54] HINGE STRUCTURE

[75] Inventor: Clifford E. Erickson, Louisville, Ky.

[73] Assignee: General Electric Company, Louisville, Ky.

[22] Filed: Mar. 7, 1975

[21] Appl. No.: 556,226

[52] U.S. Cl. ..... 16/171

[51] Int. Cl.[2] ..... E05D 1/06

[58] Field of Search ..... 16/169, 128 R, 171–173, 16/DIG. 13, 168, 174–177, 163; 220/334, 336, 340, 343, 339

[56] References Cited

UNITED STATES PATENTS

| | | | |
|---|---|---|---|
| 2,734,222 | 2/1956 | Kiba | 16/128 R |
| 2,963,734 | 12/1960 | Huget | 16/171 |
| 3,488,793 | 1/1970 | Turpen | 16/128 R |
| 3,497,908 | 3/1970 | Zamarra | 16/171 |

*Primary Examiner*—G. V. Larkin

*Attorney, Agent, or Firm*—Frederick P. Weidner; Francis H. Boos

[57] ABSTRACT

There is provided a hinge structure for pivotally connecting a first and second member at a pivot axis. A first hinge portion has a base secured to the first hinged member and has rearwardly extending arms spaced from each other, the arms terminating with laterally extending spaced pivot pins. A second hinge portion is secured to the second hinged member with both of the end walls of the second hinge portion having a recess that is open at the back wall. These recesses receive each of the respective pivot pins of the first hinge portion such that the second hinged member acts as a bearing surface for the pivot pins. By this arrangement, when the second hinged member is moved to an open position it is spaced from the first hinged member as far as possible thereby allowing more ready access for cleaning between the two hinged members.

6 Claims, 4 Drawing Figures

HINGE STRUCTURE

BACKGROUND OF THE INVENTION

1. Field of the Invention

This invention relates to a hinge structure, and more particularly to a hinge structure for use in a laundry machine.

2. Description of the Prior Art

There is a continuing search for an inexpensive hinge structure permitting easy assembly of two hinged members and allowing easy cleaning of the area around the hinges. This is particularly true in the case of home appliances such as automatic clothes washing machines wherein the hinged lid is on the top of the machine cabinet, which location is susceptible to accumulation of dirt, laundry additives, etc.

It is desirable to provide a hinge structure wherein the hinged members, such as the machine cabinet top and lid, may be spaced a maximum distance from each other when the lid is up. With this arrangement the area around the hinges and between the raised lid and cabinet top are accessible for cleaning. It is also desirable to provide a hinge structure that is simple to mold from suitable plastic material, can be used for either right or left hand opening, and free of visible attachment means to minimize collection of dirt, laundry additives, etc.

By this invention there is provided a hinge structure that will accomplish these desirable characteristics and is inexpensive to manufacture and easy to assemble.

SUMMARY OF THE INVENTION

There is provided a hinge structure for pivotally connecting a first and second member at a pivot axis including a first hinge portion having a base secured to the first hinged member and also having rearwardly extending arms spaced from each other, the arms terminating with laterally extending spaced pivot pins. Included also is a second hinge portion secured to the second hinged member with both of the end walls of the second hinge portion having a recess that is open at the back wall. These recesses receive each of the respective pivot pins of the first hinge portion such that the second hinged member acts as a bearing surface for the pivot pins.

DESCRIPTION OF THE PREFERRED EMBODIMENT

Figure 1:
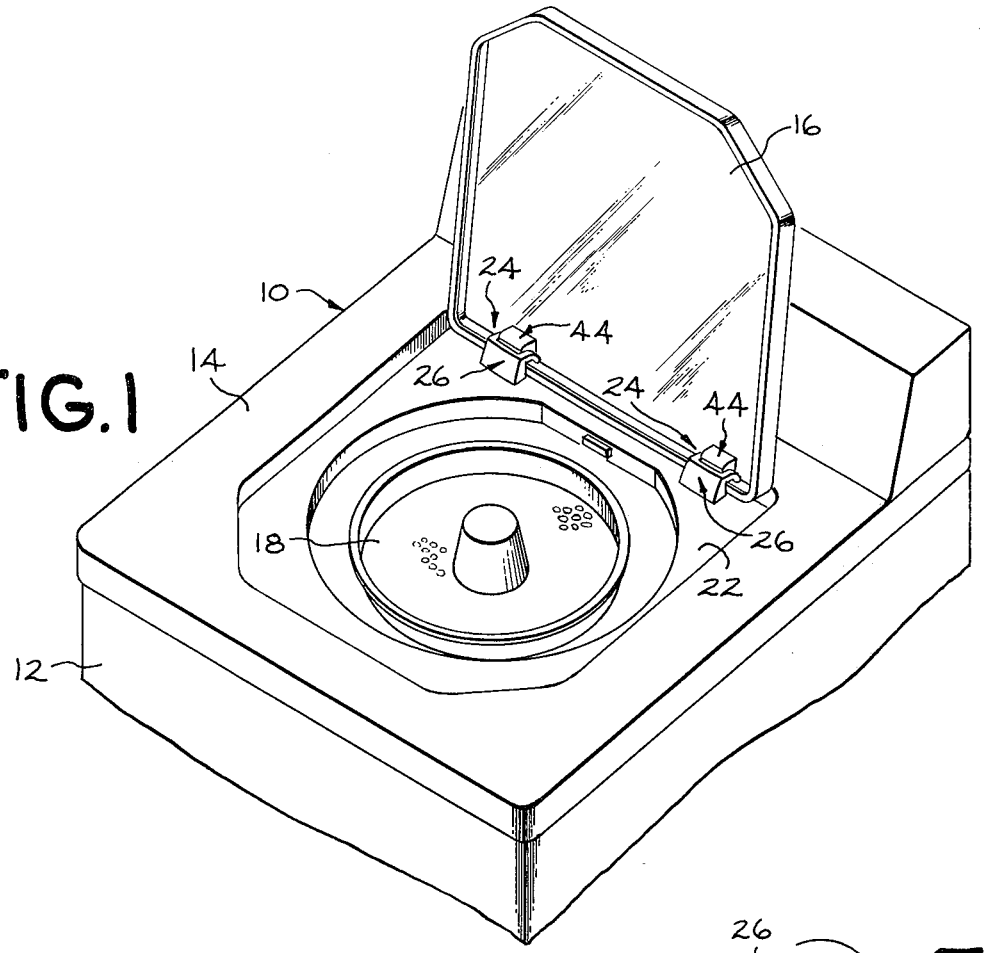
FIG. 1 is a perspective view of the top of a clothes washing machine showing the hinge structure of the invention used for attaching an access lid to the machine.

Referring now to FIG. 1 particularly, there is shown the top of a clothes washer 10 having an appearance cabinet 12 with a top wall 14 which has attached thereto a hinged access door or lid 16. The access lid may be pivotally opened exposing the interior of the washer so that the user may insert and remove fabrics to be washed and also clean the filter pan 18. The access lid 16 has a depending flange 20 completely therearound. The top wall 14 has a recessed area 22 into which the lid 16 is received when in the closed position. The access lid 16 is hingedly secured to the top wall 14 by two hinge structures 24 of this invention.

Figure 2:
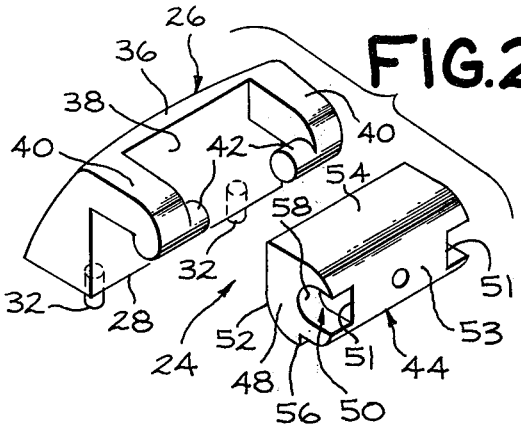
FIG. 2 is a perspective view of the hinge structure of the invention.
Figure 3:
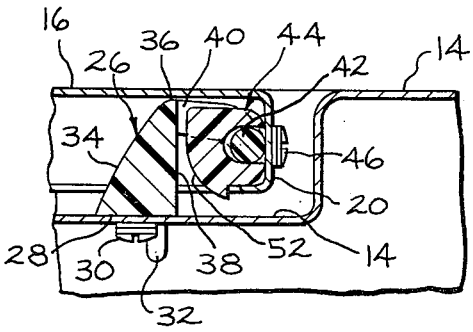
FIG. 3 is a fragmentary enlarged cross-sectional view of the hinge structure of the invention shown in FIG. 1 and with the lid closed.
Figure 4:
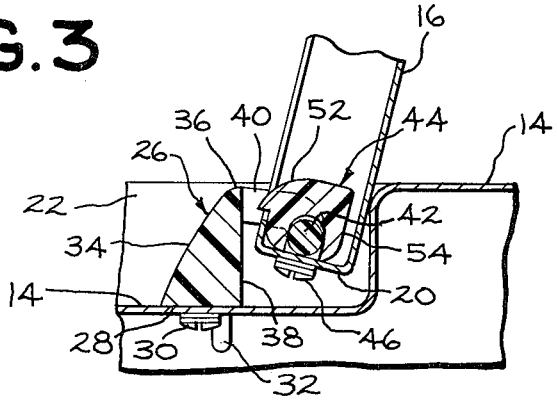
FIG. 4 is a view similar to FIG. 3 but with the lid up.

With reference to FIGS. 2, 3 and 4 particularly, the details of the hinge structure will be discussed. The first hinge portion 26 has its base 28 secured to the first hinged member which in this case is the top wall 14 of the washing machine. The first hinged portion is secured by a single screw 30 which passes through the thickness of the top wall 14 and into the body of the first hinged portion 26. To prevent the first hinged portion from rotating relative to the top wall 14 at least one stud element 32 is provided and in the preferred embodiment two such stud elements 32 are utilized. These stud elements project downwardly from the base 28 and extend into apertures (not shown) through the top wall 14. The front wall 34 is a curved surface that extends from the base 28 to the top wall 36. The back wall 38 is vertically disposed and at the top thereof are two rearwardly extending arms 40 spaced from each other and terminating with laterally extending pivot pins 42.

A second hinge portion 44 is secured to access door or lid 16 by a screw 46 passing through that portion of the depending flange 20 located at the back of the lid 16. Again the screw passes through the thickness of the depending flange and into the body of the second hinge portion 44. When the hinge structure is completely assembled it cannot rotate relative to the second hinged member as will be discussed later. The length of the second hinge portion 44 is slightly less than the distance between the spaced arms 40 of the first hinged portion so that it may be received therebetween. Both of the end walls 48 of the second hinged portion 44 have an open-ended recess 50 which recesses have a shape complementary to the pivot pins 42 of the first hinge portion. The openings 51 are at the back wall 53 in the direction of the second hinged member. The front wall 52 of the second hinge portion 44 is a curved surface and extends generally from the top wall 54 to the bottom wall 56. This curvature allows only minimum clearance between the first and second hinge portions during opening and closing the access lid 16. Such minimum clearance minimizes the amount of dirt or laundry additives that may collect in the hinge structure.

It will be noted that by this hinge structue when it is assembled so that the second hinge portion is received in the first hinged portion between the rearwardly extending arms 40 thereof and the second hinged portion is secured to the lid 16, the lid acts as a bearing surface for the pivot pins 42 because the recesses 50 are open-ended at the back wall 53 in the direction of the lid 16. For one thing, it allows the two hinged portions to be assembled and the pivot pins 42 retained in their proper position. With reference particularly to FIGS. 3 and 4, the significance of having the access lid 16 act as a bearing surface for the pivot pins will be readily understood. FIG. 3 shows the lid in the down or closed position relative to the top wall 14 of the washing machine. The pivot pins 42 are located as close to the depending flange 20 as possible and are actually in contact with that flange as a bearing surface. The other bearing surfaces are the walls 58 of the recesses 50. By this arrangement, when the lid is raised to its up position as shown in FIG. 4 the second hinged member or lid 16 is spaced from the first hinged member or top wall 14 as far as possible for a given hinge height. This allows for more ready access for cleaning between the lid and the top of the machine.

By the hinge structure described both the first and second hinge portion may be molded from suitable plastic material and their securement to the first and second hinged members may be by a single sheet metal screw for both hinge portions. When assembled the second hinge portion 44 cannot rotate relative to the lid 16 as the two extending arms 40 and opposing pivot pins 42 in cooperation with the recesses 50 prevent it.

The foregoing is a description of the preferred embodiment of the invention and variations may be made thereto without departing from the true spirit and scope of the invention, as defined in the appended claims.

What is claimed is:

1. A hinge structure for pivotally connecting a first and second member at a pivot axis including:

a first hinge portion having a base secured to the first hinged member and having rearwardly extending arms spaced from each other, the arms terminating with laterally extending spaced pivot pins, a second hinge portion secured to the second hinged member and having a rear wall, top wall, bottom wall, front wall and end walls, both of the end walls having an open-ended recess that is open at the back wall and receives each of the respective pivot pins, the rear wall being adjacent the second hinged member and the second hinged member is a bearing surface for the pivot pins.

2. The hinge structure of claim 1 wherein the laterally extending pivot pins are inwardly turned toward each other.

3. The hinge structure of claim 2 wherein the second hinge portion is retained within the space between the arms of the first hinge portion.

4. The hinge structure of claim 1 wherein the base of the first hinge portion has at least one protruding stud to be received in the first hinged member and the first hinge portion is secured to the first hinged member by a single screw.

5. The hinge structure of claim 4 wherein the second hinge portion is secured to the second hinged member by a single screw.

6. The hinge structure of claim 1 wherein the front wall of the second hinge portion is curved between the top and bottom walls to clear the first hinge portion.

* * * * *